US005320452A

United States Patent [19]

Kunito

[11] Patent Number: 5,320,452

[45] Date of Patent: Jun. 14, 1994

[54] CAST-IN-PLACE CONCRETE PILE AND METHOD OF CONSTRUCTING THE SAME IN THE GROUND

[75] Inventor: Mitsuhiro Kunito, Osaka, Japan

[73] Assignee: Kabushiki Kaisha Ask Kenkyusho, Osaka, Japan

[21] Appl. No.: 998,033

[22] Filed: Dec. 29, 1992

[30] Foreign Application Priority Data

Mar. 24, 1992 [JP] Japan ..... 4-66173

[51] Int. Cl.[5] ..... E02D 5/56

[52] U.S. Cl. ..... 405/233; 405/232; 405/256

[58] Field of Search ..... 405/233, 239, 232, 256, 405/250, 251; 106/644, 711, 705

[56] References Cited

U.S. PATENT DOCUMENTS

| | | | |
|---|---|---|---|
| 1,688,064 | 10/1928 | Upson | 405/239 |
| 2,920,455 | 1/1960 | Rysey et al. | 405/239 X |
| 4,298,660 | 11/1981 | Nakagawa | 106/644 X |
| 4,314,853 | 2/1982 | Moens | 106/644 |
| 4,382,820 | 5/1983 | Inoue | 106/644 |
| 4,917,542 | 4/1990 | Hickey | 405/239 X |
| 5,050,356 | 9/1991 | Johnson et al. | 405/239 X |

FOREIGN PATENT DOCUMENTS

| | | |
|---|---|---|
| 703647 | 4/1931 | France . |
| 0297426 | 2/0890 | Japan . |
| 2-97426 | 8/1990 | Japan . |
| 436389 | 10/1935 | United Kingdom . |
| 1123953 | 8/1963 | United Kingdom . |

*Primary Examiner*—Dennis L. Taylor
*Attorney, Agent, or Firm*—Armstrong, Westerman, Hattori, McLeland & Naughton

[57] ABSTRACT

A cast-in-place concrete pile essentially consists of a lower concrete layer having fibers intermixed therein and an upper concrete layer having reinforcing elements. The lower portions of the reinforcing elements are embedded in the lower concrete layer to increase the bonding strength between the lower and upper concrete layers. The cast-in-place concrete pile of the present invention is constructed according to the following method. That is, an excavated hole is firstly formed in the ground. The reinforcing elements are placed at the upper side of the excavated hole, and then concrete including the fibers is cast into the excavated hole until the lower portions of the reinforcing elements are embedded in thus cast concrete, so that the lower concrete layer is formed. Continuously, concrete is cast onto the lower concrete layer in the excavated hole to form the upper concrete layer. Since thus constructed cast-in-place concrete pile is integrated in one-piece, it is expected that the concrete pile has high confidence and safety.

6 Claims, 3 Drawing Sheets

CAST-IN-PLACE CONCRETE PILE AND METHOD OF CONSTRUCTING THE SAME IN THE GROUND

BACKGROUND OF THE INVENTION

1. Field of the Invention

The present invention relates to a cast-in-place concrete pile and a method of constructing the same in the ground.

2. Description of Prior Art

Heretofore, a cast-in-place concrete pile has been constructed by excavating the ground, inserting steel bars into thus excavated hole over the full length of the excavated hole, and then casting concrete into the excavated hole. However, recently a cast-in-place concrete long pile having the length of about 50 m to 60 m is required at a filled up land and the others. In such case, it takes a long time period and considerable labor for inserting the steel bars over the full length of the excavated hole. Utility Model Unexamined Publication No. 02-97426 proposes a cast-in-place concrete pile consisting of a steel fiber mixed lower concrete layer and a reinforced upper concrete layer including the steel bars. The concrete pile is designed such that the formation of cracks in the lower part of the concrete pile is prevented by the mixed lower concrete layer. On the other hand, a bending stress and a shear force occurring from, for example, an earthquake, a strong wind, etc., are borne by the reinforced upper concrete layer. And besides, as the steel bars are included only in the reinforced upper concrete layer, working hours and labor necessary for inserting the steel bars into the excavated hole can be reduced. The prior art written in the Utility Model Unexamined Publication No. 2-97426 describes about a method of constructing the cast-in-place concrete piles in the ground. That is, the excavated hole is formed in the ground. Concrete including steel fibers is cast into the bottom of the excavated hole, and then placing the steel bars on the thus cast concrete in the excavated hole. Subsequently, concrete is cast into the excavated hole to form the reinforced upper concrete layer on the mixed lower concrete layer. However, since the lower portions of the steel bars are not embedded into the mixed lower concrete layer, the bonding strength between the mixed lower concrete layer and the reinforced upper concrete layer is not enough to integrate the concrete pile in one-piece. Moreover, since the specific gravity of iron of the steel fibers, which is about 7.8, is much larger than that of an aggregate such as pebbles or sand, etc., which is about 2.7, the steel fibers are apt to sink toward to the bottom of the excavated hole as compared with the aggregate until the concrete including the steel fibers is hardened. As a result, it may be not expected that the steel fibers are uniformly dispersed in the mixed lower concrete layer. That is, the steel fibers are densely distributed to the lower side of the mixed lower concrete layer and sparsely distributed to the upper side of the mixed lower concrete layer. Therefore, there is a possibility that the upper side of the mixed lower concrete layer does not have a designed strength thereof. Consequently, there are serious problems with respect to the strength of the upper side of the mixed lower concrete layer and the bonding strength between the mixed lower concrete layer and the reinforced upper concrete layer. On the other hand, when fluidity of the concrete including the steel fibers is lowered, the sinking of the steel fibers having the high specific gravity is prevented to some extent. However, if the fluidity of the concrete including the steel fibers is lowered excessively, it is so difficult to cast the concrete with tremie tube into the bottom of the excavated hole having the depth of 50 m to 60 m.

SUMMARY OF THE INVENTION

The present invention relates to a cast-in-place concrete pile and a method of constructing the same in the ground. That is to say, as illustrated in FIG. 1, the cast-in-place concrete pile 10 essentially consists of a lower concrete layer 30 having fibers 20 intermixed therein and an upper concrete layer 50 having reinforcing elements 40. Since the upper concrete layer 50 has the reinforcing elements 40 the lower portions of which project into the lower concrete layer 30, the bonding strength between the lower and upper concrete layers is improved, so that the concrete pile 10 is integrated in one-piece. And also, even if the fibers 20 are sparsely distributed to the upper part of the lower concrete layer 30 as compared with the lower part of the lower concrete layer, the upper part of the lower concrete layer can be reinforced by the reinforcing elements 40 embedded therein.

Therefore, it is a primary object of the present invention to provide a cast-in-place concrete pile comprising a lower concrete layer having fibers intermixed therein and an upper concrete layer having reinforcing elements, the lower portions of which project into the lower concrete layer.

On the other hand, for constructing the cast-in-place concrete pile 10 of the present invention, Firstly, the reinforcing elements 40 are placed at the upper side of an excavated hole 60 which is formed in the ground 70. Concrete including fibers 20 is cast on the bottom of the excavated hole 60 to form the lower concrete layer 30, so that the lower portions of the reinforcing elements 40 are embedded in the lower concrete layer 30. And then, concrete is cast into the excavated hole 60 to form on the lower concrete layer 30 in the excavated hole the upper concrete layer 50 having the reinforcing elements 40. Since the reinforcing elements 40 are placed only at the upper side of the excavated hole 60, even if the excavated hole is a deep hole having the depth of, for example, about 70 m to 80 m, working hours and labor necessary for inserting the reinforcing elements 40 into the excavated hole 60 can be considerably reduced. And also, as the concrete can be cast into the excavated hole 60 to form the upper concrete layer 50 immediately after the concrete including the fibers 20 is cast into the excavated hole, the lower and upper concrete layers are strongly bonded, so that thus constructed cast-in-place concrete pile are integrated in one-piece.

Therefore, it is another object of the present invention to provide a method of constructing a cast-in-place concrete pile comprising a lower concrete layer having fibers intermixed therein and an upper concrete layer having reinforcing elements, which has an increased bonding strength between the upper and lower concrete layers to integrate the concrete pile in one-piece.

In a preferred embodiment of the present invention, the fibers 20 included in the lower concrete layer 30 are selected from a metallic fiber, for example, steel, a glass fiber, a mineral fiber and a synthetic fiber, etc., and the reinforcing elements 40 are made of steel.

DESCRIPTION OF THE PREFERRED EMBODIMENTS

Figure 1:
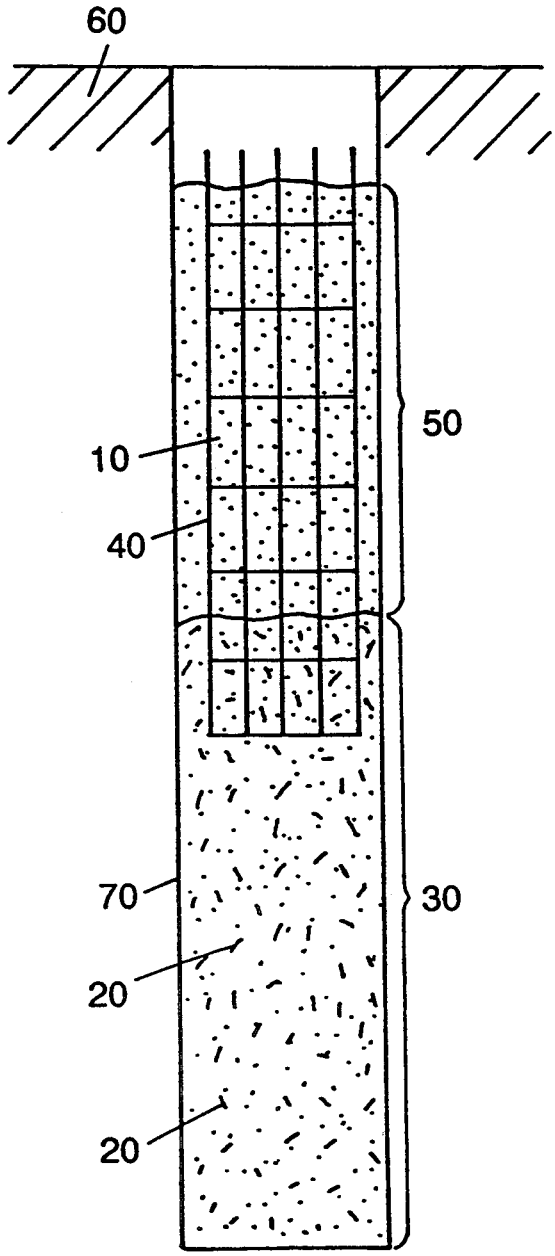
FIG. 1 is a sectional view of a cast-in-place concrete pile constructed in the ground of the present invention.
Figure 2A:
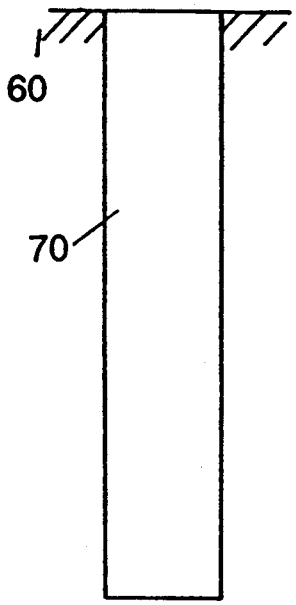
FIGS. 2A to 2F show steps of constructing the cast-in-place concrete pile according to the present invention.
Figure 2B:
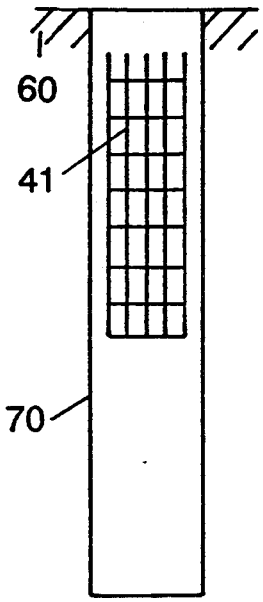
Figure 2C:
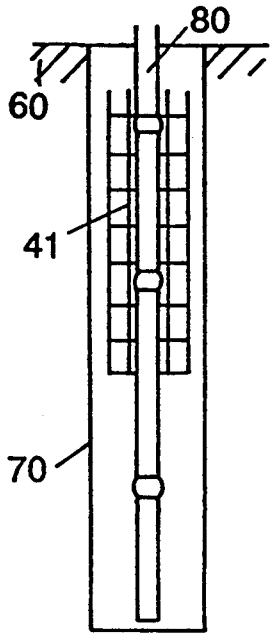
Figure 2D:
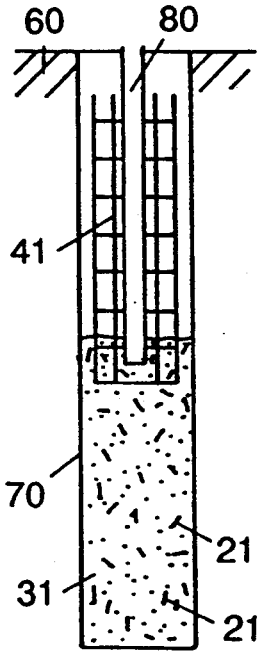
Figure 2E:
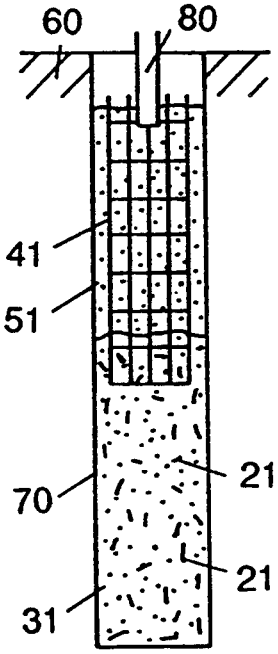
Figure 2F:
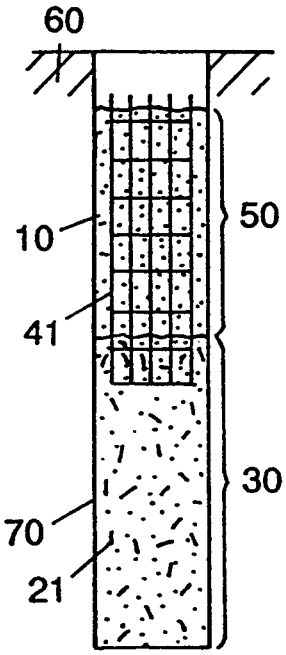
Figure 3:
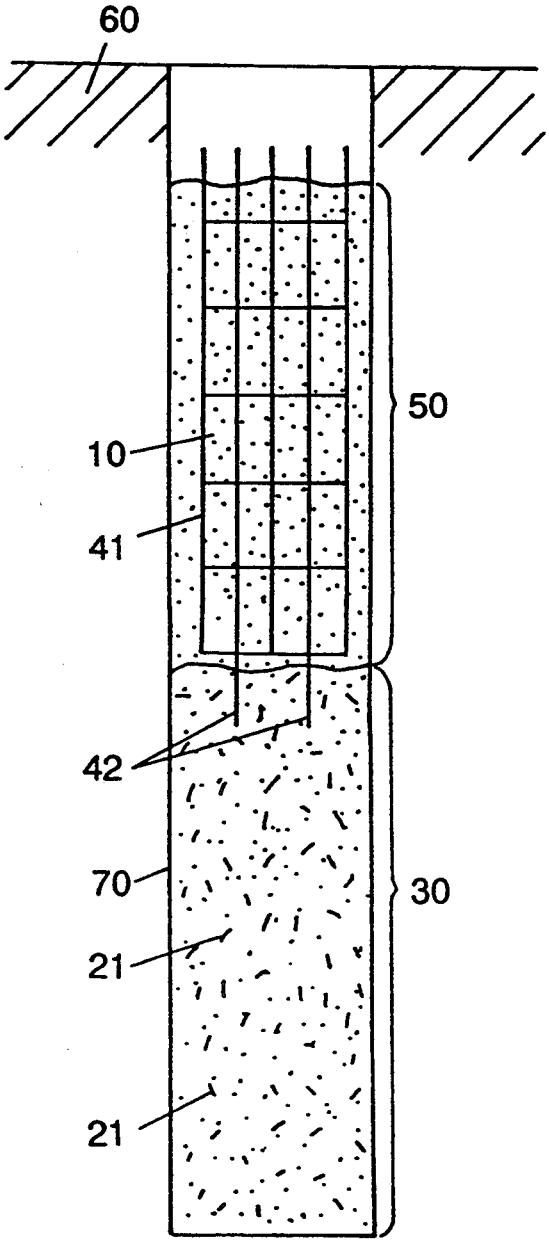
FIG. 3 is a sectional view of another cast-in-place concrete pile constructed in the ground of the present invention.

Hereinafter, the present is described in detail according to drawings appended in this specification. A cast-in-place concrete pile of the present invention is constructed in accordance with the following steps, as shown in FIGS. 2A to 2F. That is to say, as shown in FIG. 2A, an excavated hole 70 is firstly formed by excavating the ground 60 according to the known excavation method such as, for example, an earth drill method, a reverse circulation method and the Benoto method, etc. After an arrangement of steel bars 41 is performed, the steel bars are placed at the upper side of the excavated hole 70 by hanging with an optional hanging method, as shown in FIG. 2B. Subsequently, a tremie tube so is inserted in the excavated hole 70. Concrete 31 including steel fibers 21 is cast onto the bottom of the excavated hole through the tremie tube 80 while pulling up the tremie tube slowly, as shown in FIG. 2C. The casting of the concrete 31 is continued until the lower portions of the steel bars 41 are embedded into the concrete 31, so that a lower concrete layer 30 having the steel fibers 21 intermixed therein is formed in the excavated hole 70, as shown in FIG. 2D. Continuously, concrete 51 is cast on the lower concrete layer 30 in the excavated hole 70 to form an upper concrete layer 50 including the reinforced steels 41, as shown in FIG. 2E. After the concrete 51 is cast up to a predetermined position in the excavated hole, the concrete is hardened. Thus constructed cast-in-place concrete pile 10 essentially consists of the lower concrete layer 30 and the upper concrete layer 50, as shown in FIG. 2F. Since the lower portions of the steel bars 41 are embedded into the concrete 31 including the steel fibers 21, and also the concrete 51 is cast on the concrete 31 in the excavated hole 70 before the concrete 31 is hardened, the bonding strength between the upper concrete layer 30 and the lower concrete layer 50 is remarkably improved, so that the concrete pile 10 is integrated in one-piece. By the way, it is not concerned that a few projections 42 of the steel bars 41 are projected toward to the bottom of the excavated hole 70, and embedded in the concrete layer 30, as shown in FIG. 3. In the present invention, for example, a steel fiber having the length of about 3 cm to 6 cm and the diameter of about 0.3 mm to 1.5 mm is used as the steel fibers 21 in the lower concrete layer 30. And besides, a steel fiber having a hooked shape may be used if necessary. Of course, the length, diameter and shape of the steel fiber may not be limited to those mentioned above. It is not concerned that a metallic fiber, a glass fiber, a mineral fiber and/or a synthetic fiber, etc., are used instead of the steel fiber. Since the specific gravity of iron in the steel fibers 21, which is about 7.8, is much larger than that Of an aggregate such as pebbles or sand, etc., which is about 2.7, the steel fibers is apt to sink toward to the bottom of the excavated hole as compared with the aggregate until the concrete 31 is hardened. Therefore, it may be not expected that the steel fibers 21 are uniformly dispersed in the lower concrete layer 30. That is, the steel fibers 21 are densely distributed to the lower part of the lower concrete layer 30 and sparsely distributed to the upper part of the lower concrete layer. In this case, there is a possibility of lowering the strength of the upper part of the lower concrete layer 30. However, in the present invention, since the lower portions of the steel bars 41 are embedded in the upper part of the lower concrete layer 30, the strength of the upper part of the lower concrete layer is improved, and also the lower concrete layer 30 is strongly bonded with the upper concrete layer 50 through the steel bars 41.

Consequently, in the present invention, the strength of the upper part of the lower concrete layer 30 of the concrete pile 10, and the bonding strength between the lower concrete layer 30 and the upper concrete layer 50, can be increased, so that it is expected that the cast-in-place concrete pile of the present invention has high confidence and safety.

Although the above described method is preferred for constructing the cast-in-place concrete pile of the present invention, the concrete pile may be formed by any other suitable different method.

What is claimed is:

1. A cast-in-place concrete pile comprising a lower concrete layer having fibers intermixed therein and an upper concrete layer having steel reinforcing elements, said steel reinforcing elements in said upper concrete layer extending downward with the lower portions of said steel reinforcing elements in an upper portion of said lower concrete layer, to thereby obtain a mixing state of the lower portions of said steel reinforcing elements and said fibers in an upper portion of said lower concrete layer.

2. A cast-in-place concrete pile as set forth in claim 1, wherein said fibers are selected from the group consisting of a metallic fiber, a glass fiber, a mineral fiber and a synthetic fiber.

3. A cast-in-place concrete pile as set forth in claim 1, wherein said fibers are made of steel.

4. A method of constructing a cast-in-place concrete pile comprising the steps of:

excavating the ground to form an excavated hole;

casting a concrete including intermixed fibers into said excavated hole to fill a lower portion of said excavated hole with said concrete having said fibers intermixed extending upward from the bottom of said excavated hole and around the lower portion of said steel reinforcing elements placed at an upper side of said excavated hole to thereby form a lower concrete layer in said excavated hole; and casting another concrete into said excavated hole to form an upper concrete layer around said steel reinforced elements and on said concrete layer in said excavated hole.

5. A cast-in-place concrete pile as set forth in claim 1, wherein some of said steel reinforced elements have lower portions projecting downwardly by a greater distance than the other of said steel reinforcing elements so that said steel reinforcing elements project downwardly by a greater distance project selectively into said lower concrete layer having said fibers intermixed therein.

6. A method of constructing a cast-in-place concrete pile as set forth in claim 4 wherein said concrete including fibers is cast into the lower portion of the excavated hole to form said lower concrete portion, said reinforcing elements are then positioned in said excavated hole with the lower ends of said reinforcing elements extending into an upper portion of said lower portion having said fibers therein, and concrete, free of said fiber, is cast into the upper portion of said excavated hole, with said reinforcing elements therein, and fills said upper portion of said excavated hole with concrete.

* * * * *